United States Patent [19]

Stephanoff

[11] 3,937,405

[45] Feb. 10, 1976

[54] APPARATUS FOR MIXING PULVERIZING AND GRINDING BLACK POWDER

[75] Inventor: Nicholas N. Stephanoff, Haverford, Pa.

[73] Assignee: Fluid Energy Processing and Equipment Company, Hatfield, Pa.

[22] Filed: Dec. 4, 1974

[21] Appl. No.: 529,373

Related U.S. Application Data

[62] Division of Ser. No. 425,938, Dec. 18, 1973.

[52] U.S. Cl. ..... 241/39

[51] Int. Cl.[2] ..... B02C 19/06

[58] Field of Search ..... 241/5, 39, 43

[56] References Cited

UNITED STATES PATENTS

| | | | |
|---|---|---|---|
| 2,325,080 | 7/1943 | Stephanoff | 241/5 |
| 2,590,219 | 3/1952 | Stephanoff | 241/5 X |
| 3,317,145 | 5/1967 | Stephanoff | 241/5 |
| 3,497,326 | 2/1970 | Solodacha | 241/39 X |
| 3,595,486 | 7/1971 | Stephanoff | 241/5 |

*Primary Examiner*—Granville Y. Custer, Jr.
*Attorney, Agent, or Firm*—Arthur A. Jacobs, Esq.

[57] ABSTRACT

A system for making black powder comprising a jet mill into which potassium nitrate, carbon and sulfur, plus any other desired additive, are inserted, the particles being mixed, pulverized and ground in a vortex of gaseous fluid while the vortex is moved through a curvilinear path in the mill, the smaller, lighter particles being centrifugally separated from the larger heavier particles and then exhausted from the mill, the mill being constructed to decelerate the particles during initial mixture and to thereafter accelerate them through the curvilinear path, the system also including a second jet mill into which are introduced the particles exhausted from the first mill plus an additional coating material, the entire mixture being caused to tumble and roll slowly in the second mill to effect improved smoothing and coating.

6 Claims, 2 Drawing Figures

APPARATUS FOR MIXING PULVERIZING AND GRINDING BLACK POWDER

This is a division of application Ser. No. 425,938 filed Dec. 18, 1973 now allowed.

This invention relates to the pulverization, mixing, grinding, coating, and polishing of the components of black powder, and more particularly relates to such treatment by the use of "jet" or "fluid energy" mills.

Black powder consists essentially of an oxidizing agent such as potassium nitrate ($KNO_3$), charcoal and sulfur, with the optional addition of specific additives for specific purposes, as, for example, wood flour which is used to slow the burning for use in fuses or the like.

In the usual preparation of the black powder, the three essential raw materials are first pulverized separately, then mixed and ground together, this mixing and grinding constituting what is called "incorporation". After the incorporation step, resulting in the production of what is called "meal black powder", this meal powder is compacted, then disintegrated, then sieved and finally polished, the polishing consisting of rounding and smoothing the particles by abrasion (called "glazing") and then "finishing" which constitutes further smoothing by abrasion during which time a coating of finely pulverized carbonaceous material such as graphite is applied to the particles.

These various steps were heretofore accomplished in separate mills, the pulverization taking place in ball mills, needle mills or hammer mills and the grinding and mixing taking place in other ball mills or in stamping or wheel mills. These mills were used because they were adaptable to small batches and were relatively slow. This was considered necessary because the fine grinding of the carbon or charcoal made it more reacitve and more subject to explosion. Slower grinding in these mechanical mills generated less heat and smaller batches provided less explosive material to lessen the danger of explosion. Furthermore, mixing the charcoal and sulfur spearately and then inserting the potassium nitrate, provided less time for the fully explosive mixture in the mill.

The aforesaid process was commercially disadvantageous because of the time consumed in the painstaking procedure — usually about 6 to 12 hours or even longer — for the grinding of each batch during the incorporation step.

It was then proposed to overcome the difficulties and time consumption of the old process by eliminating the mechanical mills and substituting so-called "jet" or "fluid energy" mills, the same type of "jet" mills being used both for pulverization and incorporation and for polishing.

"Jet" or "fluid energy" mills utilize the particles themselves as the abrading and grinding means. This is accomplished by passing a stream of high velocity gaseous fluid through a curvilinear path. The particles are passed into the whirling stream of gas where they are engaged in a vortex action in which they collide and pulverize each other. At the same time they are whirled through the curvilinear path together with the gaseous stream. During this whirling action, the smaller, lighter particles are centrifugally separated from the larger, heavier particles and centrifugally exhausted from the mill while the heavier particles are returned for further pulverization with fresh material. It is a characteristic of these "jet" mills that a certain amount of heat energy is absorbed by the gaseous fluid during passage through the nozzles because of expansion of the gas, so that a cooling effect is obtained despite the heat generated by the pulverization and grinding.

The aforesaid proposed method attempted to utilize the inherent cooling effect of the"jet" mills to speed up the process by pre-mixing the three essential components prior to insertion into the mill and then continuously passing a stream of the premixed composition through the mill, thereby avoiding the necessity of slow grinding and the use of small batches. It was supposed that the incorporation step could take place in the completely dry state because the meal black powder prepared in this manner had no significant dusting and, therefore, it was not necessary to use moisture to bind the dust and increase compressibility, nor was it believed that water was necessary for safety. It was proposed to optionally add water to the cyclone dust collector which received the meal black powder after incorporation, but even this was not considered really necessary, nor was there any conception of the amount of water to be added or in what manner.

Although the above-described jet mill process was a distinct improvement over the old use of mechanical mills insofar as speeding up the process was concerned, the danger of explosion was still siginficant because of the dry state of the atmosphere during incorporation, due to the compressed gas expansion, such dry state increasing the possibility of sparking because of static electricity. It was, further, apparently not realized that the bulk of the cooling effect in jet mills was due not so much to expansion of the gases but to the evaporation of moisture, if any, in the mill. The evaporation of the moisture, being an endothermic process, absorbs the heat produced by the grinding. Another thing not apparently realized was that the same type of jet mill cannot be satisfactorily used for both incorporation and polishing since the grinding effect necessary for the incorporation step would reduce the particles to useless dust during the polishing step and this would be so even though the load in the mill is increased and the pressure or velocity of the gaseous fluid is decreased. In fact, if the velocity of the gaseous fluid is reduced too much, the centrifugal action of the mill is deleteriously affected.

It is one object of the present invention to overcome the disadvantages of both the original method of producing black powder and the formerly proposed jet mill process by providing a process and a system for practicing such process which permits rapid production by the use of jet mills, but which does so in a completely safe manner and a manner to provide a completely satisfactory and improved product.

Another object of the present invention is to provide a process of the aforesaid type which is relatively simple and easy to use.

Other objects and many of the attendant advantages of this invention will be readily appreciated as the same becomes better understood by reference to the following description when read in conjunction with the accompanying drawings wherein.

Figure 1:
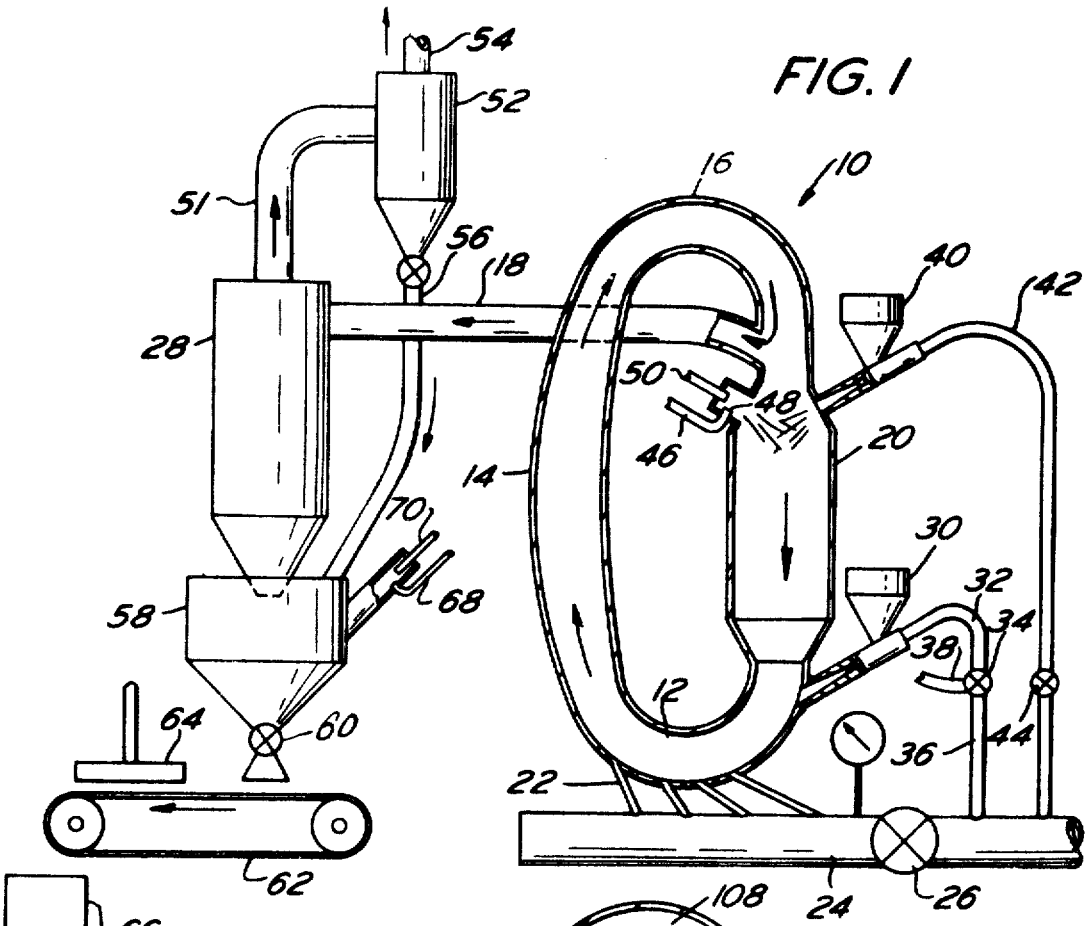
FIG. 1 is a generally schematic view of a jet mill system embodying the present invention, said system being utilized for the pulverization and incorporation steps used in the production of black powder.

In accordance with the present invention, it has been found that in order to eliminate any possibility of static electricity sparking, there must be sufficient moisture in the mill to provide a relative humidity (RH) of between about 85-95 percent. On the other hand, an overabundance of free moisture causes adhesion of the particles resulting in aggolmeration. Such agglomeration interferes with satisfactory grinding. The introduction of the water together with the raw feed is also not satisfactory since this induces localized adhesion of the particles even before the grinding takes place and hinders the grinding. It is, therefore, necessary not only to provide the proper amount of moisture to obtain a substantially constant RH value under variable temperature and pressure conditions, but the moisture must be introduced into the mill in the proper manner. In other words, as the temperature of the air changes for the same pressure and other operating conditions, in order to retain an RH of 85–95 percent in the atmosphere of the mill, the quantity of water added must also change; the higher the temperature, the more water must be added into the mill.

In addition to the above, in accordance with the present invention, the water is introduced into the mill in the form of a fine spray mist with the particles of water or other coolant preferably in a size range of about 0.01 to 10 microns. The amount of water entering the mill should be automatically metered in accordance with varying temperatures and pressures in the mill to retain 85–95 percent RH. This metering can be effected by any standard control means which may include a valve device, the opening of which is varied in accordance with a thermostat device set in a proper area of the mill. Such heat-controlled valves are not, per se, part of the present invention, but any standard type may be used.

The water is dispersed into the fine mist by any desired means such as by a continuous stream of high-pressure air causing fine atomization of the water. This water mist or spray is directed into an incoming stream of potassium nitrate which is fed into the mill separately from the carbon and sulfur feed. The water, in addition to being dispersed into a fine mist, is preferably heated to a temperature higher than ambient, most preferably to a temperature between about 70° to 100°C. This is done to permit more potassium nitrate to dissolve in the water mist, because potassium nitrate is sparingly soluble in cold water but easily soluble in hot water. In this respect, 100 grams of water will dissolve 246 grams of $KNO_3$ at 100°C, whereas at 20°C it will dissolve only 20 grams.

The collision of the water particles in the mist with the potassium nitrate particles dissolves at least a portion of the potassium nitrate and disperses the remainder so that there is created a spray of potassium nitrate, both dissolved and dispersed, which is directed toward the fed stream of carbon and sulfur mixture. As the potassium nitrate-water spray passes toward the carbon-sulfur mixture, the spray is slowed down by an expanded portion in the downstack part of the mill, so that, upon impact, the mixing of the three components and the adsorption of the potassium nitrate on the carbon and sulfur is effected over a period of time sufficient to complete the mixture and adsorption. The more potassium nitrate in solution, the better, because the solution is not only more easily adsorbed onto the carbon but is also more easily absorbed thereinto to effect an impregnation of the carbon.

The mixing of the potassium nitrate and carbon-sulfur feed does not take place until just about the time that pulverization and grinding begins. This is because charcoal (carbon) becomes highly activated at the instant of breakage into fine nascent particles. This activation is especially high immediately upon breakage of the carbon particles while the broken surfaces are still rough and channeled, and therefore present greater areas of adsorption and retention of other materials. This reactivity is rapidly reduced as the surfaces of the carbon particles begin to heal or smoothen out.

In addition to the above, the carbon is preferably introduced in a chilled state, lower than ambient temperature, and, most preferably, lower than 0°C. For example, the carbon may be pre-cooled to very low temperatures in liquid air or nitrogen. There are at least two reasons for this: (a) carbon is much more absorptive when cold than when warm, for example, a piece of charcoal which will absorb 18 times its volume of oxygen at 0°C, will absorb 230 times its own volume at −185°C. (the temperature of liquid air); and (b) the cold carbon and sulfur mixture will dissipate the heat resulting from the use of warm water in the spray directed against the dispersed potassium nitrate and from the heat generated by the grinding action. Though cooling is effected by the gas expansion itself, this further cooling action has been found most desirable.

Although the spray has been described as water so as to perform the double function of moisture additive and potassium nitrate dispersant and solvent, it is possible to add the water by other means and to use any other desired fluid in the spray. In this respect, the fluid may be a coolant material where it is not desired to obtain any great degree of solution of the potassium nitrate.

The mixture, together with whatever additives are required, is then pulverized, mixed and ground in the usual manner in the jet mill and the meal is passed therefrom into a cyclone collector or the like. From there it passes to a hopper where any additional moisture which may be required is added. The mixture then drops onto a conveyor where it is compacted. It is then disintegrated and sieved in the usual manner.

The product is now ready for polishing. The polishing is effected in another jet mill, but not the same type as used for the incorporation. This polishing mill is somewhat similar to the first one but is somewhat reversed in that is has an expanded portion in the upstack part of the mill, that is, in the part of the mill downstream from the part in which admixture of the components takes place. This is to permit the particles of the mixture to slow down and tumble over each other at the same time that they continue to travel around the mill. This permits smoother glazing and more satisfactory coating of the particles, which are the aspects of this polishing operation.

The components used in the polishing step are (a) the product of the incorporation, compacting, disintegration and sieving described above, and (b) graphite or the like. The polishing operation, as described above, comprises rounding and smoothing the particles by abrasion with each other (glazing) and further smoothing and simultaneous coating with graphite or the like (finishing). Both operations are carried out simultaneously in the jet mill used for this purpose.

The powder from the first mill and the graphite are introduced into the mill by adjacent feed means and then passed through a first portion of the mill where low-pressure, low velocity air streams entrain them and cause glazing, after which they pass through the expanded portion of the upstack where finishing takes place. The finished particles are then centrifugally exhausted from the mill to a cyclone collector, from where they pass to a hopper as a finished product.

Referring now in greater detail to the drawings wherein similar reference characters refer to similar parts, there is shown in FIG. 1 a jet or fluid energy mill, gnerally designated 10, comprising an inlet section 12, an upstack 14, a classification section 16, an exhaust duct 18 and a downstack 20. The exhaust duct 18 is connected to an exhaust outlet on the inner periphery of the mill between the classification section 16 and the downstack 20.

The inlet section 12, upstack 14 and classifier section 16 all preferably combine to constitute a "tractrix" or antifriction, constant acceleration curveture, such as disclosed in U.S. Pat. No. 3,648,936, dated Mar. 14, 1972, to permit most efficient operation and to obviate undue wear of the mill. The downstack 20 is made of expanded shape for the purpose of decreasing the velocity of the particles to permit more efficient mixing thereof and a greater time for adsorption and absorption of the potassium nitrate into the carbon and, to a lesser extent, the sulfur particles.

The mill 10 operates in the general manner of such mills, having a tengential inlet nozzles 22 leading from a manifold 24 into the inlet section 12.

The nozzle tips are preferably provided with non-friction plastic liners such as nylon or the like, to decrease the possibility of generation of static electricity.

The manifold 24 is connected to a source of high pressure gaseous fluid, such as air, through a valve 26. The high pressure air, entering through inlets 22, each of a somewhat different tangential angle, creates a vortex within the inlet section 12 because of the impact of the different streams of air but, at the same time, the vortex is propelled through the upstack 14 because of the tangential angles of the inlets. Raw feed particles entering through inlets hereinafter described, are entrained in the vortex and pulverize and grind each other at the same time that these particles are carried by the air through the upstack 14 and into the classification section 16. During the passage, the lighter particles are centrifugally separated from the heavier particles, the lighter particles passing along the radially inner wall of the mill and the heavier particles along the radially outer wall. This classification is completed in the classification section 16, and, during their descent toward the downstack 20, the lighter particles pass through the exhaust outlet to the duct 18 from where they pass to a cyclone dust collector 28. The heavier particles return through the downstack 20 to the inlet section 12, being admixed during this travel with fresh raw feed.

The raw feed comprises as indicated previously, three essential components, namely potassium nitrate, carbon (charcoal) and sulfur. The carbon and sulfur may be fed into the mill separately or in pre-mixed admixture, the latter being preferred. As indicated in the drawing, a mixture of carbon and sulfur is fed into the mill through a hopper 30, the particles of the mixture being propelled into the mill by a stream of gaseous fluid, such as air, under pressure, such gaseous fluid being shown as supplied by a conduit 32. The conduit 32 is connected by a valve 34 to two separate, alternatively utilized conduits, indicated at 36 and 38 respectively. The conduit 36 leads into the manifold 24 and utilizes the same high pressure air (usually at room temperature) as is passed through the inlets 22. The conduit 38 is connected to a source (not shown) of chilled fluid which may be a cold gas, or which may be liquid air, nitrogen or the like.

The potassium nitrate is inserted separately into the mill, and whereas the carbon-sulfur mixture is inserted through hopper 30 situated below the downstack, the potassium nitrate is inserted through a hopper 40 situated above the downstack. The potassium nitrate is propelled into the mill by high pressure gaseous fluid supplied by a conduit 42. The conduit 42 is connected through a valve 44 to the manifold 24.

Both the inlets from hoppers 30 and 40 are preferably provided with Venturi passages in order to increase the velocity of their respective fluids.

The inlet from hopper 40 is directed at a downward angle so that the fed potassium nitrate moves angularly into the downstack. At the opposite side of the downstack is an inlet duct 46 connected to a source of warm water (not shown), the water being preferably at a temperature of between about 70° to 100°C. The inlet end 48 of the duct 46 is offset so that the water issuing therefrom is propelled into impact with a stream of high pressure air or the like issuing from a duct 50 connected to a source of high pressure air or the like, which may be the manifold 24 or any other desired source. The high pressure air, upon impact with the water, atomizes the water and projects a fine spray or mist angularly down toward impact with the potassium nitrate particles issuing from the hopper 40. As described above, this warm water spray not only wets the potassium nitrate particles but dissolves a substantial portion thereof while dispersing the remainder on the spray. The heated spray of potassium nitrate is slowed during passage through the expanded downstack and mixes intimately with the carbon-sulfur mixture, the warm spray being readily adsorbed and absorbed on the carbon particles which are particularly activated as they are simultaneously pulverized.

In ordinary circumstances, the carbon-sulfur mixture is fed into the mill by high pressure air or the like directed from the manifold 24 through conduits 36 and 32. However, if greatly increased absorption is required, the carbon-sulfur mixture is fed by either chilled or liquid gas directed from a source thereof through conduits 38 and 32. The use of chilled fluid is also effective in cooling the heated temperature caused by the introduction of the heated potassium nitrate spray.

Both the use of the chilled or liquid gas for the carbon-sulfur feed and the hot water spray for the potassium nitrate feed are optional, although the use of one or both is much preferred in order to obtain the most satisfactory product with the least danger.

When the mixture passes through the duct 18 into the collector 28, the gaseous fluid passes from the collector 28 through a duct 51 into filter 52 from where clean gas is exhausted through a duct 54 while residual powder passes through conduit 56 to a receiver 58. The receiver 58 also receives the separated solids from collector 28. The solid mixture passes to a rotary valve 60 through which the mixture is dropped onto a conveyor 62. While on the conveyor 62, the mixture is compacted by a compactor 64. The compacted mass then passes to a disintegrator and sieve for grading the powders, which mechanisms are indicated generally at 66.

Any additives, such as wood flour or the like, may be introduced into the mill either in admixture with the carbon and sulfur or through a separate feed inlet.

It may sometimes be desirable to incorporate additional moisture into the mixture in receiver 58. This is accomplished through a duct 68 and gas nozzle 70 similar to those shown at 46 and 50.

Figure 2:
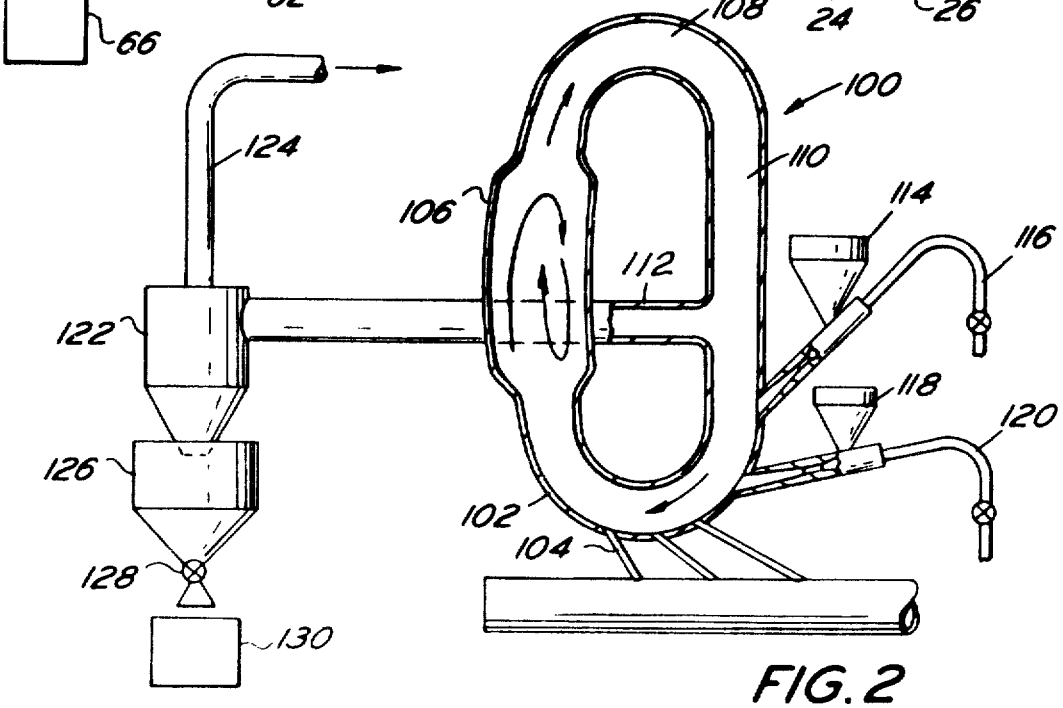
FIG. 2 is a generally schematic view of a jet mill system embodying the present invention, said system being utilized for the polishing step.

The incorporated product produced by the system of FIG. 1 is now introduced into the system shown in FIG. 2 for polishing. The polishing system comprises a jet or fluid energy mill, generally designated 100, which is, in many respects, similar to the mill 10 in that it has an inlet section 102 provided with tangential gaseous fluid inlets 104, an upstack 106, a classification section 108, a downstack 110 and an exhaust duct 112. However, low pressure, rather than high pressure air is passed through the inlets 104. A hopper 114, having a high pressure fluid conduit 116 for propelling the material into the mill, is provided below the exhaust duct 112, this hopper being used for insertion of the incorporated mixture into the mill 100. A second similar hopper 118 having a high pressure fluid conduit 120 is provided below the hopper 114, this hopper 118 being used for the introduction into the mill of finely divided graphite.

In contrast to the mill 10, the upstack 106 of the mill 100, although still preferably provided with the tractrix configuration, has an expanded portion while the downstack 110 is relatively narrow. By means of this construction, as the mixture passes through the upstack, the particles are not only moving relatively slowly due to the low pressure air, but are further slowed down by the expanded upstack 106. As a result, the particles tumble and roll over each other, as indicated by the arrows in FIG. 2. This not only prevents excessive grinding while permitting rounding and smoothing, but increases the coating action of the graphite on the incoporated particles.

The product which passes from exhaust duct 112 into a cyclone collector 122 is then freed from gaseous fluid, which flows upwardly through duct 124, and passes down into receiver 126 from where it passes through rotary valve 128 into a container 130 for the finished product.

Although the above process and apparatus is preferred, especially with regard to the separate insertion of the potassium nitrate and the carbon-sulfur mixture, it is possible to introduce all three components together above the expanded downstack portion 20 of the mill 10, since the expanded downstack mill will still act to slow the movement of the particles sufficiently to obtain a good mixture and the relatively short time in the mill will somewhat alleviate the danger of explosion.

It is to be noted that the mills and all other components of the system should be electrically grounded in order to avoid electrostatic sparking and the consequent danger of explosion during the processing.

The invention claimed is:

1. In a system for producing black powder from a mixture comprising potassium nitrate, carbon and sulfur, a mill of curvilinear shape having an inlet section, an upstack section leading from said inlet section, and a classifier section connecting said upstack section to a downstack section, said downstack section leading into said inlet section, all of said sections being in fluid connection with each other, a plurality of gaseous fluid nozzles connected to a source of high pressure gaseous fluid, said nozzles leading tangentially into said inlet section, feed means for said potassium nitrate, carbon and sulfur, said feed means leading into said mill adjacent said downstack, said downstack having at least a portion thereof expanded relative to the remainder of said mill, and an exhaust outlet from the inner peripheral wall of said mill between said classifier section and said downstack section, and a feed means for the carbon and sulfur, the feed means for the potassium nitrate being provided separately from the feed means for the carbon and sulfur, the feed means for the potassium nitrate being upstream from said expanded portion of said downstack section and the feed means for the carbon and sulfur being downstream from said expanded portion.

2. The system of claim 1 wherein a fluid spray means is provided in said mill with the spray outlet in opposed position relative to the outlet of the feed means for the potassium nitrate to direct a fluid spray into impact with the potassium nitrate as it issues from its feed means.

3. The system of claim 2 wherein said spray means is connected to a source of water heated to a temperature above ambient.

4. The system of claim 1 wherein a cooling means is provided to cool the carbon to a temperature below ambient prior to insertion of said carbon into said mill.

5. The system of claim 1 wherein a second mill is provided to further process the product produced in the first mill, said second mill also being of curvilinear shape with an inlet section, an upstack section, a classifier section and a downstack section, all said sections being in fluid communication with each other, a plurality of gaseous fluid nozzles connected to a source of low pressure gaseous fluid, said nozzles leading tangentially into the respective inlet section, an exhaust outlet from the inner peripheral wall of said second mill, and feed means adjacent said downstack section for the product processed by said first mill, said upstack section having at least a portion thereof expanded relative to the remainder of said second mill.

6. The system of claim 5 wherein a second feed means is provided adjacent said downstack section of said second mill for the introduction into said second mill of a coating material.

* * * * *